US007669560B2

(12) United States Patent
Elsbett

(10) Patent No.: US 7,669,560 B2
(45) Date of Patent: Mar. 2, 2010

(54) GAS EXCHANGE CONTROL MECHANISM FOR AN OPPOSED-PISTON ENGINE

(75) Inventor: Günter Elsbett, Roth (DE)

(73) Assignees: Otto Daude, Dresden (DE); Joachim Simon, Wittenberg (DE)

( * ) Notice: Subject to any disclaimer, the term of this patent is extended or adjusted under 35 U.S.C. 154(b) by 368 days.

(21) Appl. No.: 11/630,566

(22) PCT Filed: Jul. 5, 2005

(86) PCT No.: PCT/EP2005/007250

§ 371 (c)(1),
(2), (4) Date: Apr. 9, 2007

(87) PCT Pub. No.: WO2006/002982

PCT Pub. Date: Jan. 12, 2006

(65) Prior Publication Data

US 2008/0115771 A1 May 22, 2008

(51) Int. Cl.
*F01B 15/02* (2006.01)
*F01L 7/02* (2006.01)

(52) U.S. Cl. ..... 123/50 B; 123/51 B; 123/81 C; 123/188.5

(58) Field of Classification Search ..... 123/42, 123/50 R, 50 A, 50 B, 51 R–51 BD, 81 R, 123/81 C, 188.1, 188.4, 188.5, 196 V
See application file for complete search history.

(56) References Cited

U.S. PATENT DOCUMENTS

| | | | | |
|---|---|---|---|---|
| 1,075,383 | A | 10/1913 | Rose | |
| 2,781,749 | A | 2/1957 | Stucke | |
| 3,084,678 | A * | 4/1963 | Lindsay | 123/51 BA |
| 5,081,963 | A | 1/1992 | Galbraith | |

FOREIGN PATENT DOCUMENTS

| | | |
|---|---|---|
| DE | 633 278 | 7/1936 |
| DE | 2 145 200 | 9/1971 |
| GB | 477 975 | 4/1936 |
| GB | 497 300 | 12/1938 |
| GB | 1 015 189 | 12/1965 |

OTHER PUBLICATIONS

International Search Report for PCT/EP2005/007250, dated Oct. 18, 2005.

* cited by examiner

*Primary Examiner*—Noah Kamen
(74) *Attorney, Agent, or Firm*—Wolf, Greenfield & Sacks, P.C.

(57) ABSTRACT

A gas exchange control mechanism for an opposed-piston engine which opens and closes inlet and outlet slots provided in the cylinder irrespective of the position of the pistons. The opposed pistons are guided completely or partially during stroke in sliding sleeves during operation of the engine. The sleeves may reciprocate mechanically, electrically, pneumatically or hydraulically in a linear manner. The sliding sleeves are adapted to open and close gas guide channels located in the engine housing.

12 Claims, 4 Drawing Sheets

GAS EXCHANGE CONTROL MECHANISM FOR AN OPPOSED-PISTON ENGINE

RELATED CASE INFORMATION

Figure 1:
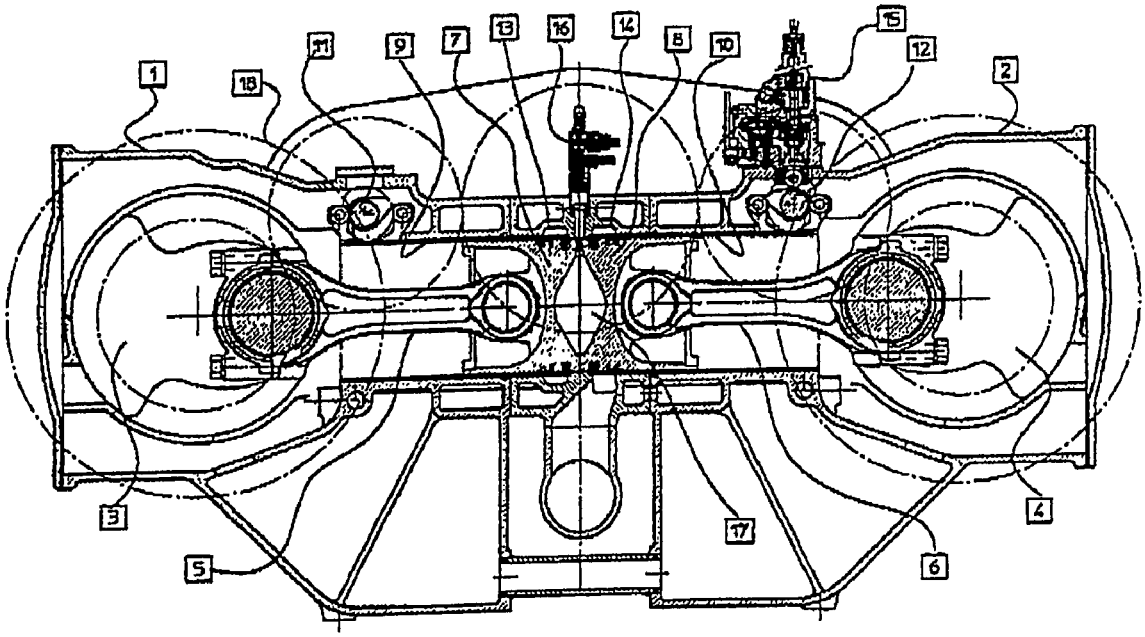

This application is a National Stage application of International Application No. PCT/EP2005/007250, filed Jul. 5, 2005, which claims priority to German Application No. DE 10 2004 032 452.2, filed Jul. 5, 2004.

The problems associated with the burning of fossil fuels such as limited resources, environmental pollution and climate change have led to a number of concepts for reducing the fuel consumption of internal combustion engines. Some of these concepts, such as the very low mechanical friction of the moving engine parts for example, have already been very well implemented in the modern technology of today's internal combustion engines and therefore there is very little potential for further optimisation. Significant progress can, however, still be achieved in the thermodynamic area. Through the further development of direct injection for diesel engines, complex injection engineering and electronic engine management, the direction has already been pre-defined. The optimisation measures also include the reduction of heat loss, as all the heat generated through combustion is fuel that is burnt needlessly unless it can be converted through gas expansion into mechanical work. In order to make such a virtually adiabatic engine operation possible, the principle of the opposed-piston engine through the absence of a cylinder head has the thermodynamic advantage of a much smaller heat-dissipating surface exposed to working gas. For this reason, the present invention mainly concerns opposed-piston engines, even though it can in principle be used for all port-controlled engines.

Opposed-piston engines work according to the two-stroke process as, because there is no top plate, no controlled valves for regulating the exchange of gas can be attached. On their way from the top to the bottom dead centre the pistons travel across slots located in the cylinder, such that the inlet and outlet channels are opened and the exchange of gas is allowed. A disadvantage of this process is that the piston rings sealing the pistons burst open when they travel across the slots so the ring cross-section has to be narrowed by means of appropriate guide webs. In addition, because of the oil-stripping effect of the rings into the slots, adhering to increasingly strict emission specifications is very difficult. The use of pistons without rings is not indicated in the trend towards higher and higher peak pressures. A change of the control times for the exchange of gas resulting from the position of the control slots is only possible through the placing of otherwise positioned slots or by staggering the synchronous operation of the crankshafts.

The object of the invention is to allow the exchange of gas in opposed-piston machines without allowing the rings to travel across the slots. This object is solved in that sliding sleeves moving in a linear manner are disposed in the cylinder, which do not open the ring channels located in the cylinder through an annular gap until, during stroke, the ring part of the piston has already passed this point or this annular gap lies outside the dead centres of the piston rings such that it is not passed at all. The movement of the sliding sleeves can be controlled by a camshaft in the classic manner, or by other actuators in a mechanical, electrical or hydraulic way.

Through the gas exchange control according to the invention by means of sliding sleeves it is possible to specify the opening and closing times of the input and output channels irrespective of the position of the pistons. Even a four-stroke process is possible: after the expansion stroke of both pistons at first only the outlet slot is opened and the working gas is expelled during the movement guiding the pistons towards each other. Then, in the top dead centre the outlet slot is closed and the inlet slot is opened, and the fresh gas is drawn in by means of the pistons pulling away from each other. In the bottom dead centre the inlet is closed and a compression and expansion stroke once again takes place with the slots closed.

If the inlet and outlet channels are disposed in the area of the top dead centres and if the gap web plate joints sealing the slots lie above the top dead point of the piston rings, this seal must be able to hold against high gas pressure. For this purpose, a narrow seal alignment must be chosen, which is possible, as the cylinder sleeves do not have to move under the high gas pressure but only towards the end of the expansion stroke until just before the start of the compression stroke, if high pressures no longer obtain. The piston rings never leave the internal slot-less contact surface of the sleeve and never travel across the opened slots.

If the inlet and outlet channels are disposed in the area of the bottom dead centres, this guarantees a better flushing of the cylinder in the two-stroke process. In this context, the pistons travel most of their way under gas pressure in a stationary cylinder sleeve. The piston rings, towards the end of the expansion stroke, travel across a practically slot-free web plate joint when crossing from the stationary cylinder sleeve to the moving sliding sleeve. During the crossing, this web plate joint is still closed and is only opened later to release the slot located beneath it. It is re-sealed in good time prior to the return of the piston. In this process, the sliding sleeves are only very slightly loaded through gas pressures and temperatures. This control of the sliding sleeves can take place through a camshaft, which also controls the injection at the same time.

DRAWING DESCRIPTION

FIG. 1 represents a main cross-section through an opposed-piston engine. It shows the two halves of the housing 1 and 2, screwed together, bearing the crankshafts 3 and 4, which move the pistons 7 and 8 across the connecting rod 5 and 6. The pistons are guided in the longitudinally movable sliding sleeves 9 and 10. The sliding sleeves can be moved across the camshafts 11 and 12 such that they open and close the gas guide channels 13 and 14 located in the housing. A camshaft also serves as a drive for the injection pump 15, which injects the fuel through the nozzle 16 into the combustion chamber 17. The two crankshafts 3 and 4 are synchronously connected by means of a gear system 18, with 2 intermediate gears serving as a drive for the camshafts 11 and 12.

Figure 2:
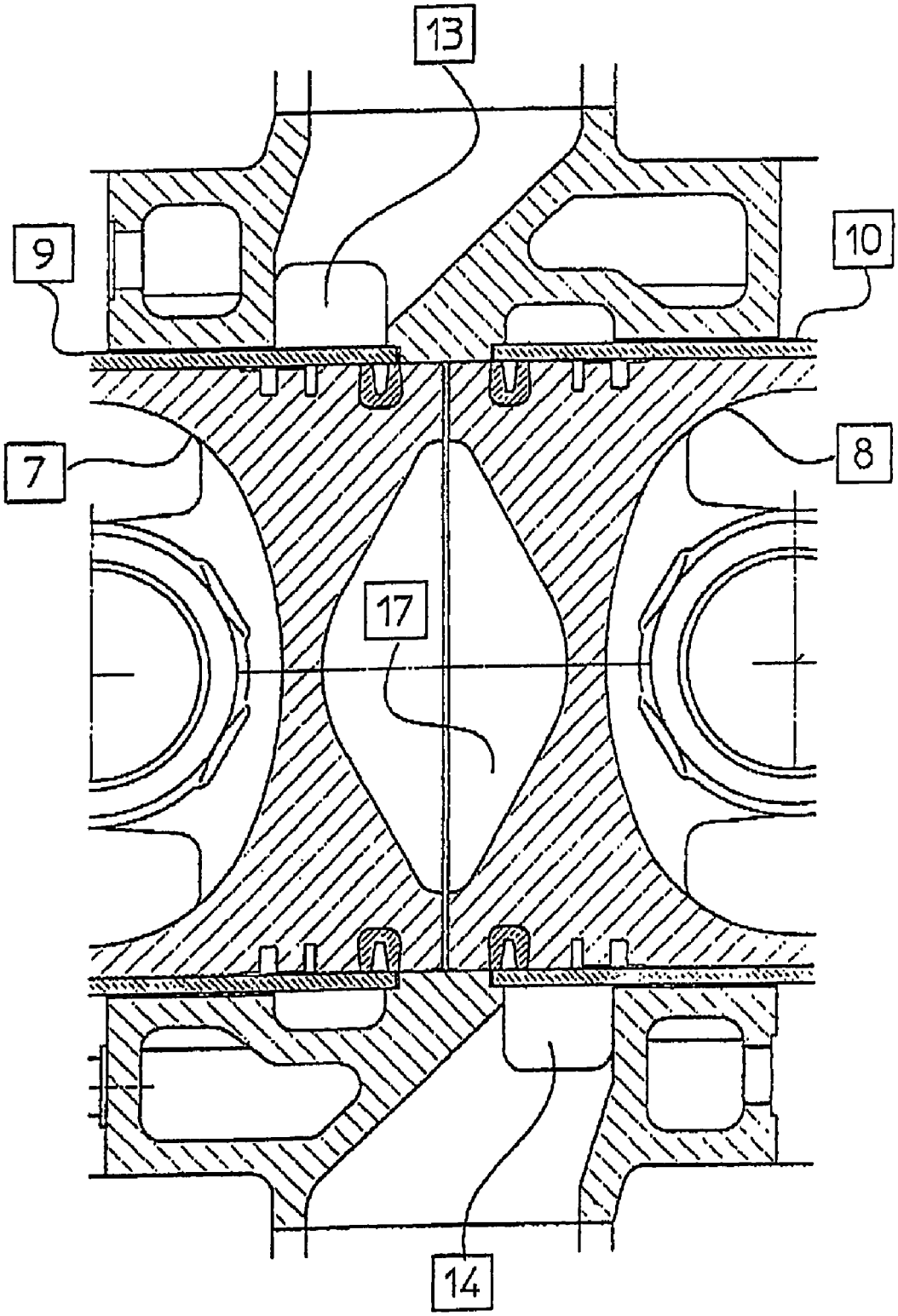

FIG. 2. shows details of the representation described above with the same reference numbers.

Figure 3:
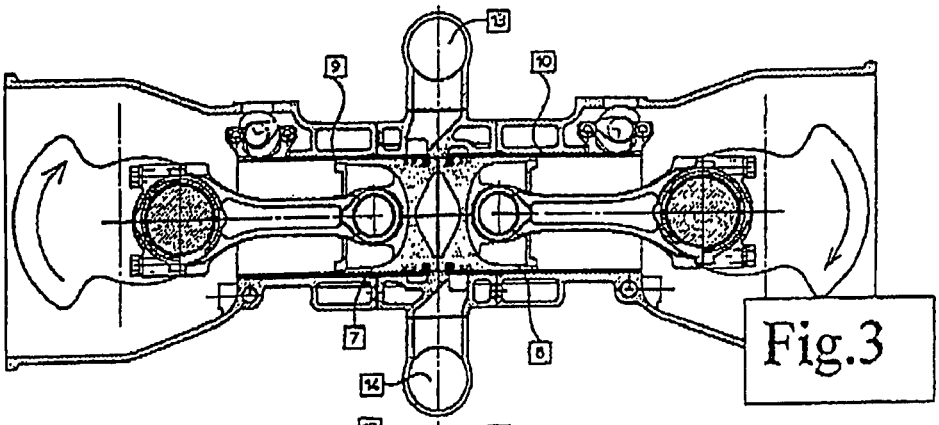

FIG. 3 shows both pistons 7 and 8 in the top dead centre. Both sliding sleeves 9 and 10 hold the gas guide channels 13 and 14 closed.

Figure 4:
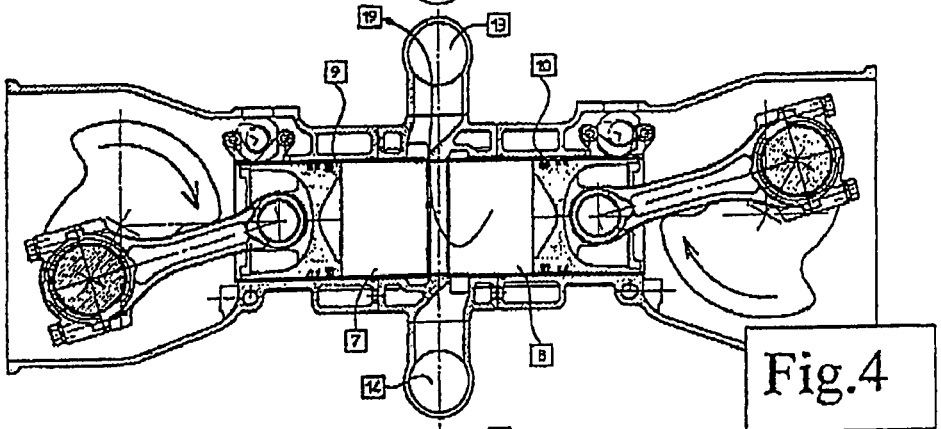

FIG. 4 shows the position of the piston shortly before the end of the expansion stroke. The sliding sleeve 9 is already open and discharges the consumed gas into the outlet channel 13, whilst the sliding sleeve 10 still holds the inlet channel closed.

Figure 5:
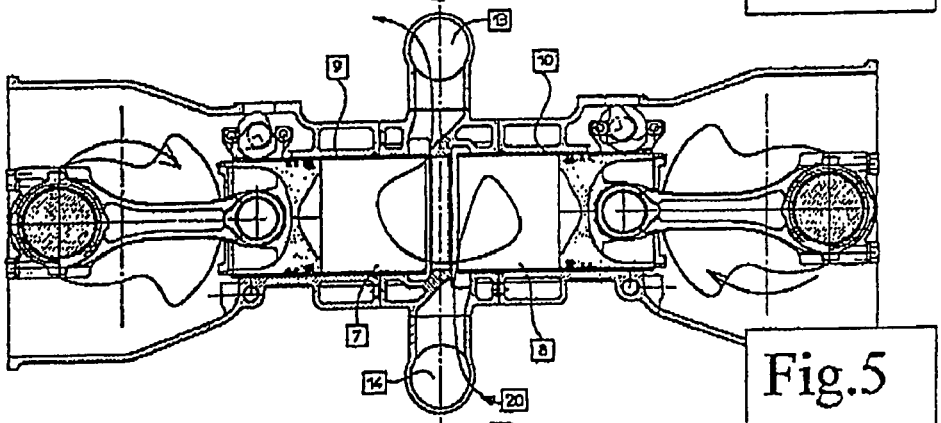

FIG. 5 shows the position of the pistons in the bottom dead centre. Both sliding sleeves have opened the channels 13 and 14. Fresh gas 20 flushes the cylinder through the inlet channel 14 and flows out again through the outlet channel 13.

Figure 6:
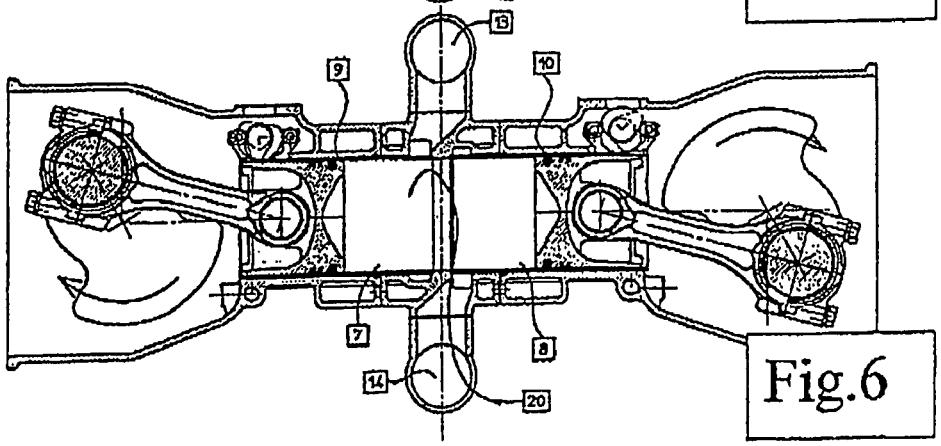

FIG. 6 shows the position of the pistons shortly after the start of the compression stroke. The sliding sleeve 9 has already closed the outlet channel 13, whilst through the still open sliding sleeve 10 fresh air 20 fills the cylinder through the inlet channel 14.

Figure 7:
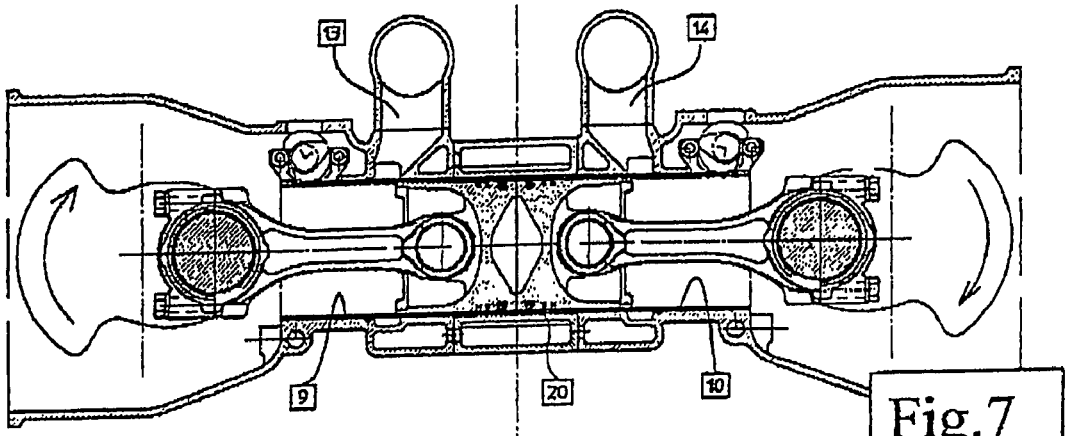

FIG. 7 shows another embodiment according to the invention of the gas exchange control mechanism through the sliding sleeves 9 and 10 and of the outlet channel 13 as well as the inlet channel 14. The pistons travel in a stationary cylinder 20 and do not reach the sliding sleeves 9 and 10 until just before the end of the expansion stroke.

Figure 8:
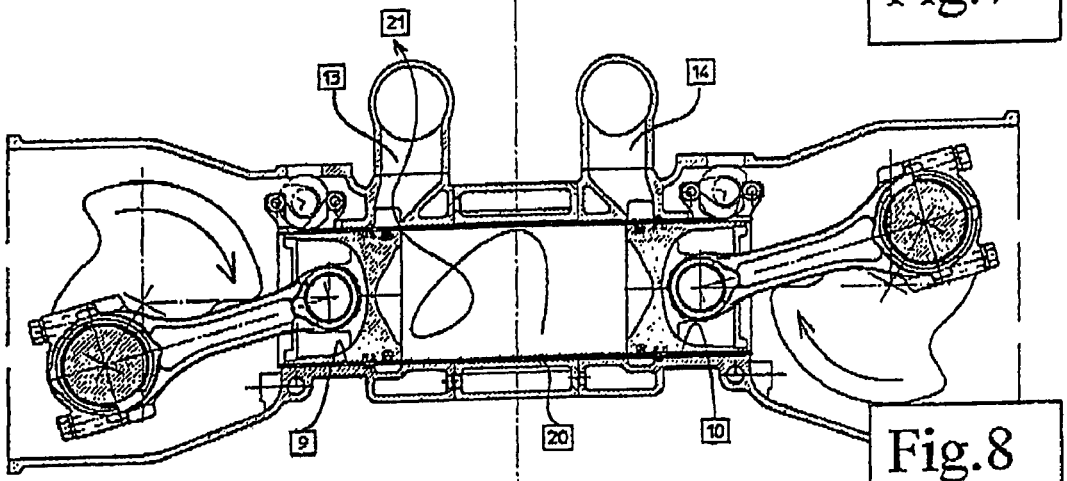

FIG. 8 shows the position of the pistons shortly before the end of the expansion stroke. The consumed gas 21 starts to flow into the outlet channel 13 across the gap that has just been opened by the sliding sleeve 9.

Figure 9:
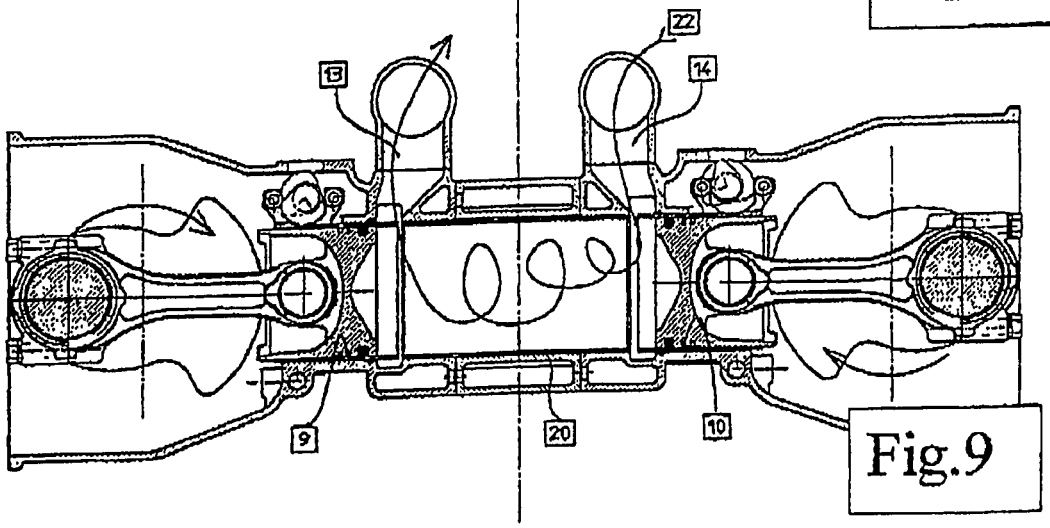

FIG. 9 shows the position of the pistons in the bottom dead centre. Fresh gas 22 flows through the inlet channel 14 across the gap opened by the sliding sleeve 10 through the cylinder and out through the outlet channel 13.

The invention claimed is:

1. A gas exchange control mechanism for an opposed-piston engine including a housing and pistons, wherein the pistons are guided completely or partially during stroke in sliding sleeves during operation of the engine so as to reciprocate mechanically, electrically, pneumatically or hydraulically in a linear manner enabling gas guide channels located in the housing receiving the sliding sleeves to be opened and closed by the sliding sleeves irrespective of the position of the pistons, wherein the linear movement of each of the sliding sleeves is controlled by a cam control device including a rotating cam profile and an abutting contact or roller surface connected to the sliding sleeve, wherein axles of intermediate wheels connecting two crankshafts of the opposed-piston engine are designed as camshafts for controlling the sliding sleeves.

2. A gas exchange control mechanism for an opposed-piston engine including a housing and pistons, wherein the pistons are guided completely or partially during stroke in sliding sleeves during operation of the engine so as to reciprocate mechanically, electrically, pneumatically or hydraulically in a linear manner enabling gas guide channels located in the housing receiving the sliding sleeves to be opened and closed by the sliding sleeves irrespective of the position of the pistons, wherein the linear movement of each of the sliding sleeves is controlled by a cam control device including a rotating cam profile and an abutting contact or roller surface connected to the sliding sleeve, wherein the cam control mechanism is forcibly guided such that one of two opposed flat or roller tappet contact surfaces lying on the cam profile and connected to the sliding sleeve is responsible for the opening movement and the other for the closing movement.

3. The gas exchange control mechanism for an opposed-piston engine according to any of claims 1 or 2, wherein a sealing gap of the sliding sleeve, together with a ring channel located beneath it, can be located at any point of the cylinder in the area between top and bottom dead centre.

4. The gas exchange control mechanism for an opposed-piston engine according to any of claims 1 or 2, wherein a sealing gap of the sliding sleeve, together with a ring channel located beneath it, is located above the internal dead point of the piston rings such that the piston rings always travel inside the sliding sleeve.

5. The gas exchange control mechanism for an opposed-piston engine according to any of claims 1 or 2, wherein a sealing gap of the sliding sleeve, together with a ring channel located beneath it, is located inside the area of the dead points of the piston rings, such that the gap occurring at the joint point is not opened until after it has been passed by the piston rings, and the gap is re-sealed before the piston rings pass this point again on their way to the top dead centre.

6. The gas exchange control mechanism for an opposed-piston engine according to claim 1, wherein the cam control mechanism is forcibly guided such that one of two opposed flat or roller tappet contact surfaces lying on the cam profile and connected to the sliding sleeve is responsible for the opening movement and the other for the closing movement.

7. An opposed-piston engine, comprising:

an engine housing including at least one cylinder and at least two gas guide channels in fluid communication with the cylinder;

a pair of sliding sleeves slidably supported in the cylinder for reciprocating linear movement during operation of the engine to open and close the gas guide channels so as to control gas exchange in the cylinder;

a pair of opposed pistons that are guided within the sliding sleeves during piston stroke, the sliding sleeves constructed and arranged to open and close the gas guide channels irrespective of the position of the pistons;

a cam control device that is constructed and arranged to control the linear movement of each sliding sleeve, the cam control device including a rotating cam profile and an abutting contact surface that is connected to the sliding sleeve; and a pair of crankshafts and intermediate wheels coupling the crankshafts, the intermediate wheels including axles that are constructed and arranged as camshafts for controlling the sliding sleeves.

8. The opposed-piston engine according to claim 7, wherein the cam control device includes two opposed contact surfaces lying on the cam profile and connected to the sliding sleeve, the cam control device being forcibly guided such that one of the opposed contact surfaces is responsible for the opening movement and the other of the opposed contact surfaces is responsible for the closing movement.

9. A opposed-piston engine comprising:

an engine housing including at least one cylinder and at least two gas guide channels in fluid communication with the cylinder;

a pair of sliding sleeves slidably supported in the cylinder for reciprocating linear movement during operation of the engine to open and close the gas guide channels so as to control gas exchange in the cylinder;

a pair of opposed pistons that are guided within the sliding sleeves during piston stroke, the sliding sleeves constructed and arranged to open and close the gas guide channels irrespective of the position of the pistons; and a cam control device that is constructed and arranged to control the linear movement of each sliding sleeve, the cam control device including a rotating cam profile and an abutting contact surface that is connected to the sliding sleeve, wherein the cam control device includes two opposed contact surfaces lying on the cam profile and connected to the sliding sleeve, the cam control device being forcibly guided such that one of the opposed contact surfaces is responsible for the opening movement and the other of the opposed contact surfaces is responsible for the closing movement.

10. The opposed-piston engine according to any of claims 7 or 9, wherein a sealing gap of the sliding sleeve and a ring channel are located in an area of the cylinder between top dead centre and bottom dead centre of the pistons.

11. The opposed-piston engine according to any of claims 7 or 9, wherein each piston includes piston rings, and wherein a sealing gap of the sliding sleeve and a ring channel are located above the internal dead point of the piston rings such that the piston rings always travel inside the sliding sleeve.

12. The opposed-piston engine according to any of claims 7 or 9, wherein each piston includes piston rings, and wherein a sealing gap of the sliding sleeve and a ring channel are located inside an area of dead points of the piston rings, wherein the gap occurring at a joint point is not opened until after the joint point has been passed by the piston rings, and wherein the gap is re-sealed before the piston rings pass the joint point again as the piston travels to top dead centre.

* * * * *